US008272148B2

(12) United States Patent
Nishiwaki et al.

(10) Patent No.: US 8,272,148 B2
(45) Date of Patent: Sep. 25, 2012

(54) SPORTS SHOES HAVING UPPER PART WITH IMPROVED FITTING PROPERTY

(75) Inventors: Tsuyoshi Nishiwaki, Kobe (JP); Norihiro Nishikawa, Kobe (JP); Yosuke Ootsuka, Kobe (JP)

(73) Assignee: ASICS Corporation, Kobe (JP)

( * ) Notice: Subject to any disclaimer, the term of this patent is extended or adjusted under 35 U.S.C. 154(b) by 573 days.

(21) Appl. No.: 12/311,844

(22) PCT Filed: Oct. 11, 2007

(86) PCT No.: PCT/JP2007/069809

§ 371 (c)(1),
(2), (4) Date: Apr. 15, 2009

(87) PCT Pub. No.: WO2008/047659

PCT Pub. Date: Apr. 24, 2008

(65) Prior Publication Data

US 2010/0269369 A1 Oct. 28, 2010

(30) Foreign Application Priority Data

Oct. 19, 2006 (JP) ..... 2006-284588

(51) Int. Cl.
*A43B 23/00* (2006.01)
*A43B 11/00* (2006.01)
*A43B 7/14* (2006.01)

(52) U.S. Cl. ..... 36/88; 36/45; 36/51

(58) Field of Classification Search ..... 36/88, 102, 36/45, 50.1, 51, 54, 55, 57
See application file for complete search history.

(56) References Cited

U.S. PATENT DOCUMENTS 4,222,183 A * 9/1980 Haddox ..... 36/114
4,255,876 A * 3/1981 Johnson ..... 36/83
4,447,967 A * 5/1984 Zaino ..... 36/45
(Continued)

FOREIGN PATENT DOCUMENTS

JP 63-127408 8/1988
(Continued)

OTHER PUBLICATIONS

International Search Report of the International Searching Authority mailed Jan. 15, 2008, issued in connection with International Patent Appln. No. PCT/JP2007/069809 (4 pages).

*Primary Examiner* — Khoa Huynh
*Assistant Examiner* — Melissa Lalli
(74) *Attorney, Agent, or Firm* — Mintz Levin Cohn Ferris Glovsky and Popeo, P.C.

(57) ABSTRACT

A sports shoe has a sole S absorbing a shock of landing, an upper U covering an instep of a foot, and a fastening member 3 fitting the upper U to the instep of the foot. The upper U has a first opening 1 from which a leg extends upwardly during wearing and a second opening 2 which is closed with a tongue, and the first and second openings 1, 2 are continuous with each other in a front-rear direction, the upper comprises a medial side portion 7 covering a medial side surface of the foot, a lateral side portion 8 covering a lateral side surface of the foot, and stretchable portions 71, 81 forming a part of the medial side portion 7 and/or the lateral side portion 8, and the second opening 2 inclines toward the medial side of the foot along a ridge line of the foot as the second opening extends toward a front of the foot.

11 Claims, 12 Drawing Sheets

U.S. PATENT DOCUMENTS

| | | | | | |
|---|---|---|---|---|---|
| 4,559,723 | A | * | 12/1985 | Hamy et al. | 36/102 |
| 4,616,432 | A | * | 10/1986 | Bunch et al. | 36/50.1 |
| 4,622,763 | A | * | 11/1986 | Adams | 36/50.1 |
| 4,813,158 | A | * | 3/1989 | Brown | 36/114 |
| 5,765,296 | A | * | 6/1998 | Ludemann et al. | 36/51 |
| 6,128,835 | A | * | 10/2000 | Ritter et al. | 36/45 |
| 6,862,820 | B2 | * | 3/2005 | Farys et al. | 36/51 |
| 7,543,397 | B2 | * | 6/2009 | Kilgore et al. | 36/50.1 |
| 2006/0162190 | A1 | | 7/2006 | Nishiwaki et al. | |

FOREIGN PATENT DOCUMENTS

| | | | |
|---|---|---|---|
| JP | 1-139710 | | 9/1989 |
| JP | 4-107607 | | 9/1992 |
| JP | 2000093204 | | 4/2000 |
| JP | 2000152804 | | 6/2000 |
| JP | 2005-160697 | | 6/2005 |
| JP | 3780296 | | 3/2006 |
| WO | WO2004/093587 | A1 | 11/2004 |

* cited by examiner

SPORTS SHOES HAVING UPPER PART WITH IMPROVED FITTING PROPERTY

TECHNICAL FIELD

The present invention relates to a sports shoe having an upper with improved fitting property.

BACKGROUND ART

The following patent documents disclose various kinds of the upper of the shoe with improved the fitting property.

[First Patent Document] Japanese publication of unexamined utility model application No. 1-139710 (FIG. 2)

[Second Patent Document] WO2004/093587 (Abstract)

[Third Patent Document] Japanese Laid-Open Patent Publication No. 2000-152804 (FIG. 1 to FIG. 3)

[Fourth Patent Document] Japanese Laid-Open Patent Publication No. 2000-093204 (Abstract)

[Fifth Patent Document] Japanese publication of unexamined utility model application No. 63-127408 (FIG. 3)

Japanese publication of unexamined utility model application No. 1-139710 discloses the upper having a cross-shaped notched portion in the central region of the front foot portion. A stretchable member is sewn on the notched portion of the upper.

WO2004/093587 discloses the upper in which the medial and lateral stretchable portions are located so as to be obliquely opposed to each other.

These patent documents, however, do not disclose an upper in which an opening of the upper closed with a tongue are provided so as to be along with a ridge line of the foot.

Japanese Laid-Open Patent Publication No. 2000-152804 discloses the shoe in which the center line of the opening of the upper is inclined with respect to the longitudinal axis of the foot.

Japanese Laid-Open Patent Publication No. 2000-093204 discloses the shoe having the winding center line of the opening of the upper.

These patent documents, however, do not disclose an upper in which a stretchable portion is provided in the medial or lateral side.

Japanese publication of unexamined utility model application No. 63-127408 discloses the shoe in which a center line of the opening of the upper is provided more medially-located than the longitudinal axis of the foot.

The center line of the opening of the shoe, however, is parallel to the longitudinal axis and is not along with the ridge line of the instep of the foot. And, this patent document does not disclose an upper in which a stretchable portion is provided with the medial or lateral side of the foot.

DISCLOSURE OF THE INVENTION

The object of the present invention is to provide a sports shoe in which an upper fits to the instep of the foot when fastening the upper by a fastening member such as a shoe lace.

One aspect of the present invention is directed to a sports shoe suitable for exercise, comprising a sole absorbing a shock of landing, an upper covering an instep of a foot, and a fastening member fitting the upper to the instep of the foot, wherein the upper has a first opening from which a leg extends upwardly during wearing and a second opening which is closed with a tongue covering the instep of the foot, and the first and second openings are continuous with each other in a front-rear direction, wherein the upper comprises: a medial side portion covering a medial side surface of the foot; a lateral side portion covering a lateral side surface of the foot; and a stretchable portion forming a part of the medial side portion and/or the lateral side portion, and being easy to be stretched, wherein the second opening inclines toward the medial side of the foot along a ridge line of the foot as the second opening extends toward a front of the foot.

In the above aspect, the second opening of the upper is provided along the ridge line of the instep of the foot. That is, the center line of the second opening is inclined with respect to the longitudinal axis of the foot so that the second opening inclines to the medial side of the foot as the second opening extends toward the front of the foot. Therefore, when fitting the upper by the fastening member, the fastening member enables the medial and lateral side portions to be come closer toward the ridge line of the instep of the foot, then improving the fitting property of the upper when wearing the shoe.

In the present invention, "along with the ridge line of the instep of the foot" means that, when fastening, the center line of the second opening is provided along a ridge line connecting the highest points of the foot in the cross section, and fastening force applied by the fastening member draws the upper toward the direction generally orthogonal to the extending direction of the ridge line. It is not necessarily the case that the ridge line of the instep of the foot is located in the second opening. The ridge line of the instep of the foot extends toward the medial side of the foot as the ridge line extends toward the front of the foot while going through the big toe, the second toe, or between the big toe and second toe. The ridge line is inclined with respect to the longitudinal axis (a line connecting the second distal phalanx and the middle of the calcaneal bone) of the foot.

The shape of the foot during exercise changes its shape inside of the shoe. Therefore, if the wearer wears a shoe having an unstretchable upper and fits the upper to the instep of the wearer, the upper is unable to follow the change in shape of the foot. As a result, the sole of the foot becomes away from the inside surface of the shoe sole, or the upper interferes with the natural bending and stretching of the foot. That is, there is a problem that the fitting property of the upper during exercise is insufficient. Especially, like the above aspect of the present invention, in the case of the upper being in close contact with the instep of the foot by sufficient fastening force applied by the fastening member, the fitting property during exercise is important. Considering the above problem, in the above aspect of the present invention, the stretchable portion stretching following the change in shape of the foot is provided in at least the medial side or lateral side of the foot. As a result, the above aspect enables the upper to change its shape in response to the change in shape of the foot, and suppresses the aforementioned adverse effect.

In this aspect, it is preferred that the upper further comprises a first shape-retaining region covering at least the medial side surface of a ball of a big toe; a second shape-retaining region covering at least part of proximal phalanges of a third toe and a fourth toe; and a deformation region being provided between the first and second shape-retaining regions and being easier to deform than the first and second shape-retaining regions, wherein the deformation region is continuous with the second opening.

By providing the deformation region being easily deformed between the first and second shape-retaining regions that has a high shape-retaining property in a toe part, it enables the fitting property of the upper to be further improved. That is, with deforming the deformation region by the fastening force applied by the fastening member, it enables the medial and lateral sides of the members of the upper to be come closer to each other in the toe part. As a result, the upper can be fitted throughout from the second opening to the toe part of the foot. Therefore the fitting property of the upper in the toe part further improves.

In this case, it is further preferred that a fastening force applied by the fastening member enables the first and second shape-retaining regions to be come closer to each other, and by pulling the tongue toward the first opening, it enables a mesh-like member forming the deformation region to be extended in a longitudinal direction of the foot and to be shrunk in a width direction of the foot.

Then, although the first and second shape-retaining regions come closer to each other during fitting, the member forming the deformation region shrinks in the width direction of the foot. Therefore, the wearer is likely to feel comfortable with the upper surface of the foot when wearing the shoe.

And, it is further preferred that the first and second shape-retaining regions are each provided with a main member forming the first and second shape-retaining regions and a reinforcement member for retaining the first and second shape-retaining regions, the main member is formed by a member being continuous over the deformation region and the first and second shape-retaining regions in the width direction of the foot, and the reinforcing member is fixed on the main member.

Then, it is possible to easily form a designated shape because the deformation region, the first and second shape-retaining region are formed by the same member. That is, if these regions are formed by separate members, the upper in the toe part needs to be formed by sewing each separate member. On the other hand, with continuously forming these regions by the same member, there is no need for each separate member to be sewn. And, it is further preferred that a part of the tongue is formed by the same member which forms the deformation region and shape-retaining regions.

In addition, in the present invention, the stretchable portion is stretchable during exercise, and is comprised of the stretch material being easy to be stretched.

The deformation region is generally comprised of a material such as a fabric that is capable of being deformed when fitting the upper.

The reinforcement member is a material that is hard to be deformed so that the shape-retaining property of the shape-retaining region is maintained. The stretch material, fabric, and reinforcement member are the materials each having the different property as described below.

That is, as shown in FIG. 12D showing the relationship between stress and elongation, the stretch material is a member in which the elongation $\delta$ is proportional to the load W per unit width in a relatively wide range of the load.

On the other hand, $W/\delta$ (tensile rigidity) of the reinforcement member is far larger than that of the stretch material. Therefore, the reinforcement member is hardly stretched in practice and the proportional limit thereof is larger than that of the stretch material. A material of the deformation region, for example which is consisted of knitted fabric or woof, can be widely stretched in at least one direction under the small tensile load by the change in shape of the material, and then a length orthogonal to the stretching direction of the material can be shortened while being stretched.

For example, a mesh material having an anisotropy on the elongation characteristic may be used as the fabric. In this case, in a direction in which the mesh is easy to be elongated, an elongation of the mesh that is far larger than that of the stretch material occurs under the small stress, and the proportional limit of the mesh is smaller than that of the stretch material (e.g. mesh material shown in FIG. 12D (longitudinal direction of the foot)).

On the other hand, in the direction in which the mesh is hard to be elongated (e.g. the direction diagonal to the direction in which the mesh is easy to be elongated), $W/\delta$ (tensile rigidity) of the mesh is larger than that of the stretch material, and the proportional limit of the mesh is larger than that of the stretch material (e.g. mesh material of FIG. 12D (diagonal direction)).

Generally, a stretch material and a reinforcement member hardly have an anisotropy, and show the similar elongation characteristics in all direction.

In this aspect, it is preferred that a fastening force applied by the fastening member enables the first and second shape-retaining regions to be come closer to each other, the deformation region inclines toward the medial side of the foot as the deformation region extends from an end of the second opening toward the front of the foot, and extends toward a vicinity of an interphalangeal joint of the big toe.

Then, it is possible for the small deformation region to be formed in the front-rear direction of the foot. Therefore, the fabric of the deformation region does not twist in the width direction of the foot when fitting.

In this aspect, the upper may be comprised of a first reinforcement portion provided at an edge portion of the first shape-retaining region; and a loop-like second reinforcement portion provided at an edge portion of the second shape-retaining region, wherein each of the first and second reinforcement portion is provided with an eyelet hole into which a shoe lace which is the fastening member is inserted, and a fastening force applied by the shoe lace enables the first and second shape-retaining regions to be come closer to each other.

In another aspect of the present invention, a sports shoe suitable for exercise, comprises a sole absorbing the shock of landing, an upper covering an instep of a foot, and a fastening member fitting the upper to the instep of the foot, wherein the upper has a first opening from which a leg extends upwardly during wearing and a second opening which is closed with a tongue covering the instep of the foot, and the first and second openings are continuous with each other in a front-rear direction, wherein the upper comprises: a first shape-retaining region covering at least a medial side surface of a ball of a big toe; a second shape-retaining region covering at least part of proximal phalanges of a third toe and a fourth toe; and a deformation region being provided between the first and second shape-retaining regions and being easier to deform than the first and second shape-retaining regions, wherein a fastening force applied by the fastening member causes the deformation region to shrink in a width direction of the foot and enables the first and second shape-retaining regions to come closer to each other, the second opening inclines toward a medial side of the foot along a ridge line of the instep as the second opening extends toward a front of the foot, and the deformation region is continuous with the second opening, inclines toward the medial side of the foot as the deformation region extends toward the front of the foot from an end of the second opening, and extends for a vicinity of an interpharangeal joint of the big toe or a second toe.

In this aspect, the second opening of the upper is provided along the ridge line of the instep of the foot. That is, the center line of the second opening inclines with respect to the longitudinal axis of the foot, and is provided so as to extend toward the medial side of the foot as the center line extends toward the front of the foot. Therefore, when fitting the upper by the fastening member, the fastening member enables the medial and lateral side portions of the upper to be come closer toward the ridge line of the instep of the foot, then improving the fitting property of the upper when wearing the shoe.

And, by providing the deformation region being easily deformed between the first and second shape-retaining regions that each have a high-retaining property in a toe part, it enables the fitting property of the upper to be further improved. That is, with deforming the deformation region by the fastening force caused by the fastening member, it enables each shape-retaining region of the medial and lateral sides of the foot to be come closer to each other in the toe part of the foot. Therefore, the upper can be fitted throughout from the second opening to the toe part of the foot. As a result, the fitting property of the upper further improves.

And, by inclining the deformation region with respect to the longitudinal axis of the foot, as similar to the second opening, it enables the deformation region to be deformed small in the front-rear direction of the foot. Therefore, the fabric of the deformation region may be suppressed to be twisted in the width direction of the foot.

In addition, "the deformation region to shrink in a width direction of the foot" means that the length of the deformation region in the width direction of the foot becomes smaller because a material of the deformation region shrinks, or gets wrinkles.

In this aspect, it is preferred that the upper further has a plurality of through-holes into which a shoe lace is inserted, a part forming a forefront through-hole in the first shape-retaining region is free from being sewn on the tongue.

Then, when the first and second shape-retaining regions come closer to each other, there is difficult for the tongue to be wrinkled. In addition, in the present invention, "through-hole" includes a punched hole in which a material is just punched, and a loop formed by a rolled member as well as an eyelet hole reinforced its peripheral edge.

And, in this aspect, it is preferred that the deformation region and the second shape-retaining region are formed by a main member being continuous over the deformation region and the second shape-retaining region in the width direction of the foot, the second shape-retaining region is provided with a reinforcement member for retaining the shape of the second shape-retaining region, and the reinforcement member is fixed on the main member.

Then, it is possible to easily form a designated shape because the deformation region and the second shape-retaining region are formed by the same member. That is, if these regions are formed by separate members, the upper in the toe part needs to be formed by sewing each separate member.

On the other hand, with continuously forming these regions by the same member, there is no need for each separate member to be sewn.

In addition, it is further preferred that a part of the tongue is formed by the same member which forms the deformation region and second shape-retaining region.

In the present invention, it is preferred that a surficial member of the tongue and a surficial member of the deformation region are continuously formed by the same member in the front-rear direction.

Thus, there is no seam line seaming the members in the deformation region that shrinks in the width direction of the foot when fitting. Therefore, shrinking of the deformation region is not inhibited, and the flexibility of the deformation region is performed. And, the wearer is likely to feel comfortable with the upper surface of the toe when wearing the shoe.

Furthermore, there is no need for a plural of members to be sewn because the surficial member of the tongue and the surficial member of the deformation region are continuously formed by the same member. Therefore, it is easy to form a designated shape in the toe part of the upper.

In the present invention, it is preferred that the upper further has a plurality of through-holes into which a shoe lace which is the fastening member is inserted, one of the through-holes being at a forefront of the through-holes in the second shape-retaining region is at a forefront of all of the through-holes in the upper. Additionally, the plurality of through-holes comprises a plurality of first through-holes and a plurality of second through-holes. The shoe lace is inserted into the first and second through-holes. The first through-holes line up, along an edge of the second opening, more medially than the edge of the second opening, and the second through-holes line up, along the edge of the second opening, more laterally than the edge of the second opening. A first distance, along the width direction of the foot, between a forefront first through-hole of the first through-holes and a medial end of the shoe is smaller than a second distance, along the width direction of the foot, between a forefront second through-hole of the second through-holes and a lateral end of the shoe. And, it is preferred that a number of the second through-holes lining up on a lateral side of the foot along an edge of the second opening is larger than that of the first through-holes lining up on the medial side of the foot along an edge of the second opening.

Then, it is possible for the broad second shape-retaining region to be pulled toward the medial side of the foot in the front of the foot when fastening. Therefore, the second shape-retaining region can be easily fitted to the foot in the toe part of the foot.

In the present invention, it is preferred that the upper further has a plurality of through-holes into which a shoe lace which is the fastening member is inserted, and the shoe lace is inserted continuously into the through-holes from one of the through-holes being at a forefront of the through-holes to one of the through-holes being at a second from the forefront of the through-holes in the second shape-retaining region without being inserted into the through-holes in the medial side of the foot. That is, it is preferred that the shoe lace is continuously inserted into from one of the through-holes being at forefront to one of the through-holes being at a second from the forefront.

Then, it is possible for the second shape-retaining region to be come closer to the medial side of the foot as a line not a dot when fastening. That is, it is possible for the through-hole being at the forefront and the through-hole being at the second from the forefront to be come closer to the medial side of the foot by drawing up the shoe lace which is inserted these through-holes to the medial side of the foot. Therefore, the second shape-retaining region can be easily fitted to the foot in the toe part of the foot.

DESCRIPTION OF THE REFERENCE NUMERALS

Figure 1:
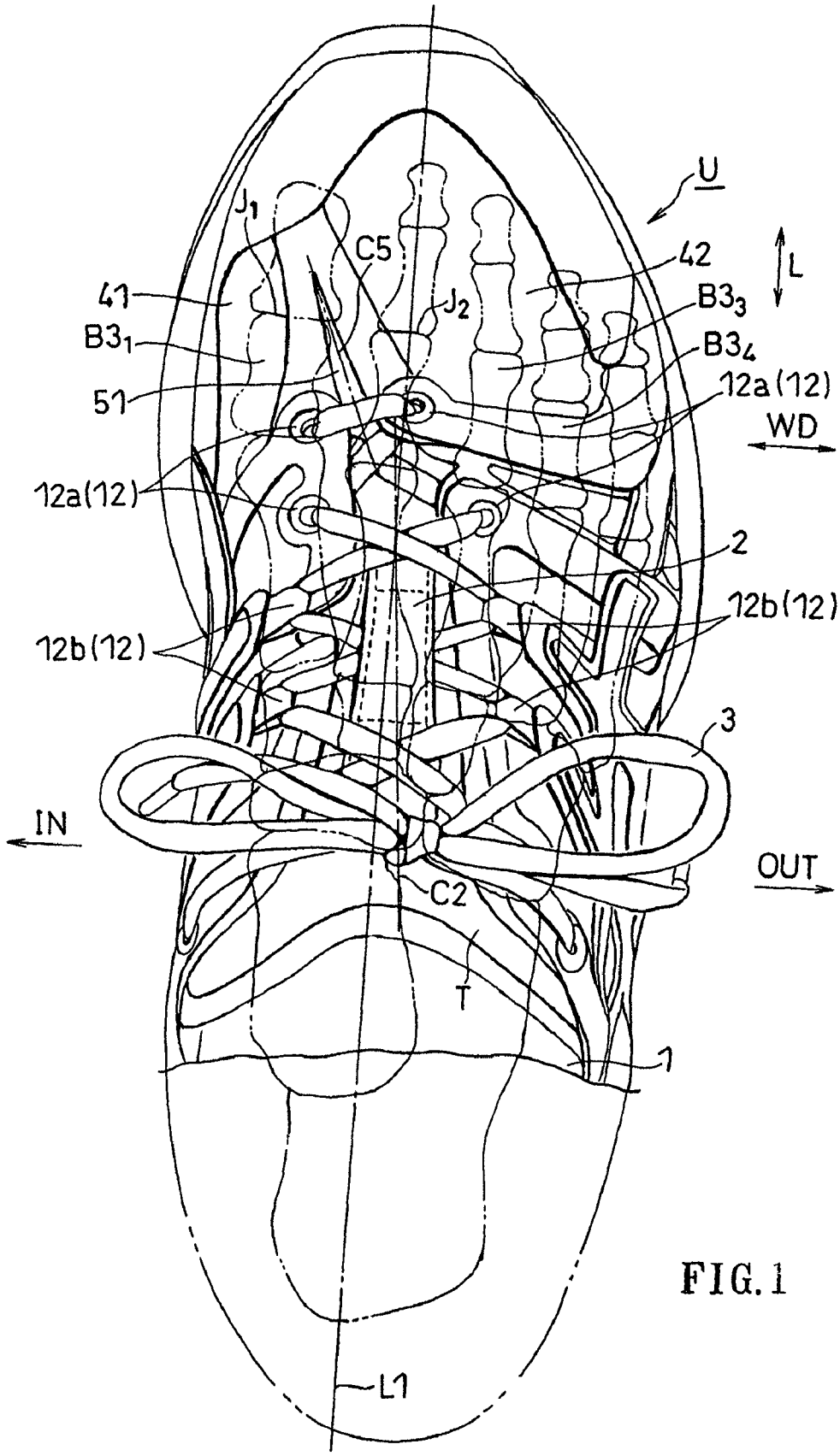
FIG. 1 is a plan view showing the relationship between the shoe of the first embodiment and foot bones.

S: Shoe sole
U: Upper
1: First Opening
2: Second Opening
3: Shoe lace
T: Tongue
41: First shape-retaining region
41*a*: First reinforcement member
42: Second shape-retaining region
42*a*: Second reinforcement member
51: Deformation region
12: Through-hole
7: Medial side portion
71: Medial side stretchable portion
8: Lateral side portion
81: Lateral side stretchable portion
O1: Ball of a big toe
B1: Distal phalanx
B3: Proximal phalanx
B4: Metatarsal bone
J: Interphalangeal joint
L: Longitudinal direction of a foot
WD: Width direction of a foot

BEST MODE FOR CARRYING OUT THE INVENTION

The present invention will be understood more clearly from the following description of preferred embodiments taken in conjunction with the accompanying drawings. Note however that the embodiments and the drawings are merely illustrative, and the scope of the present invention shall be defined by the appended claims. In the accompanying drawings, like reference numerals denote like components throughout the plurality of figures.

Embodiments of the present invention are described as follows.

First Embodiment

FIG. 1 to FIG. 5 each shows the shoe of First embodiment (for right foot). In addition, in FIG. 2, an area of the stretchable portion is as shown by dot-meshed, and a visible part of the mesh material is as shown by cross-hatching in order to easily understand a position that the stretchable portion and mesh material are provided (similarly described in FIG. 9). In the embodiment described below, a term "IN" means the medial side of the foot, and "OUT" means the lateral side of the foot.

Figure 4:
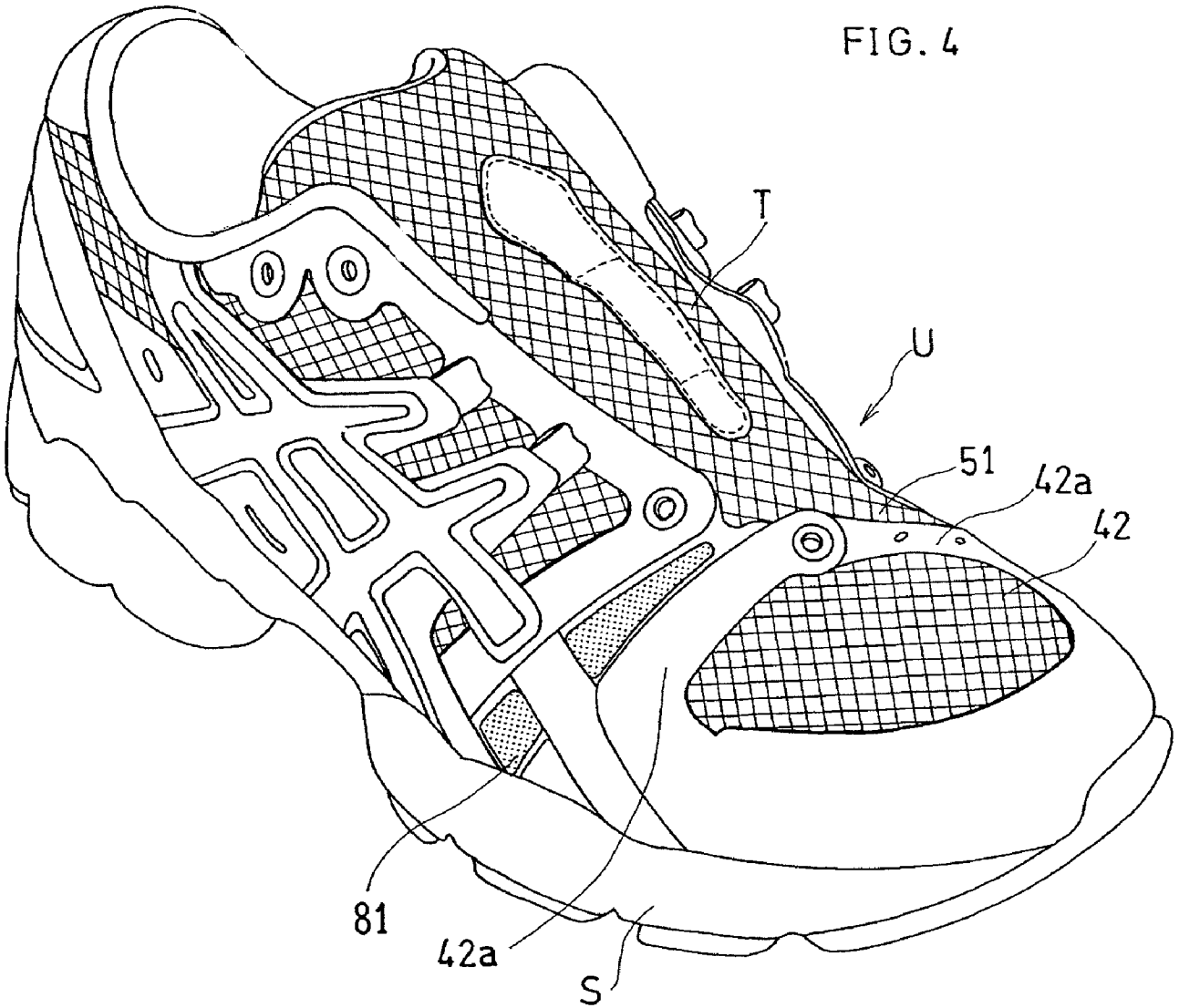
FIG. 4 is a perspective view showing the state in which the shoe lace is detached.

As shown in FIG. 4, The shoe of First embodiment has a sole S absorbing a shock of landing and an upper U covering an instep of a foot. As shown in FIG. 1, the upper U is provided with a plurality of through-holes 12 such as an eyelet hole 12*a* and a loop 12*b*.

The upper fits the instep of the foot by the shoe lace 3 (an example of a fastening member) which is inserted into the through-holes 12 being fastened.

As shown in FIG. 1, the upper U has a first opening 1 from which a leg extends upwardly during wearing and a second opening 2 which is located anterior to the first opening 1 and is closed with a tongue T. The first opening 1 and second opening 2 is continuous in the front-rear direction with each other in the longitudinal direction L of the foot. The tongue T covers the instep of the foot.

A center line C2 of the second opening 2 is provided along a ridge line of the instep of the foot which is lined within the big toe and second toe. That is, the center line C2 of the second opening 2 inclines toward the medial side IN as it extends toward the front of the foot. Therefore, the center line C2 is inclined with respect to the longitudinal axis L1 of the foot.

The upper U comprises a first shape-retaining region 41 covering at least a medial side of a proximal phalanx $B3_1$ of a big toe (first toe), a second shape-retaining region 42 covering at least a region anterior to a base of a proximal phalanx $B3_3$ of a third toe and a base of a proximal phalanx $B3_4$ of a fourth toe, and a deformation region 51 located between the first and second shape-retaining regions 41, 42.

Figure 2:
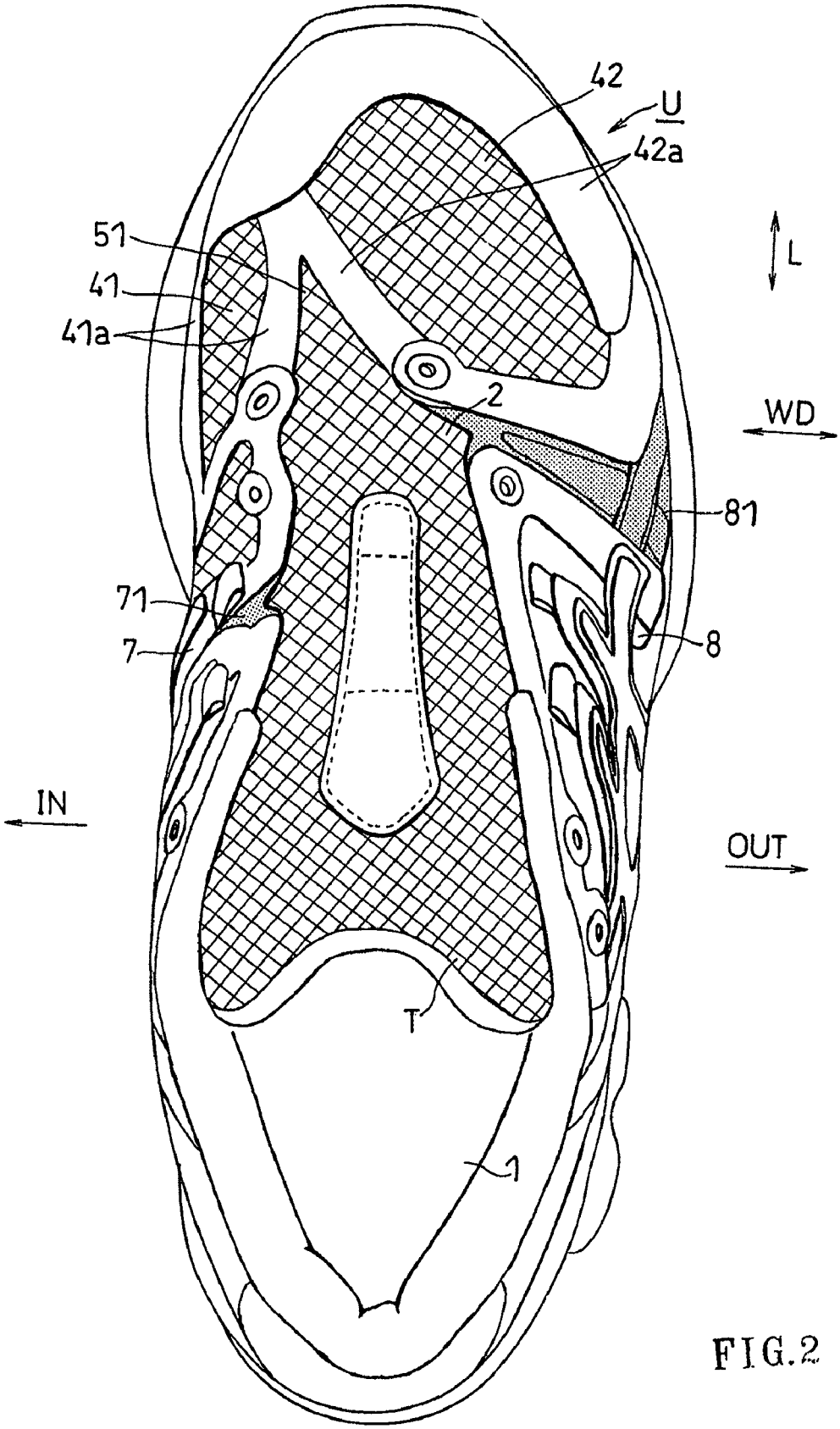
FIG. 2 is a plan view showing the state in which the shoe lace is detached.
Figure 3:
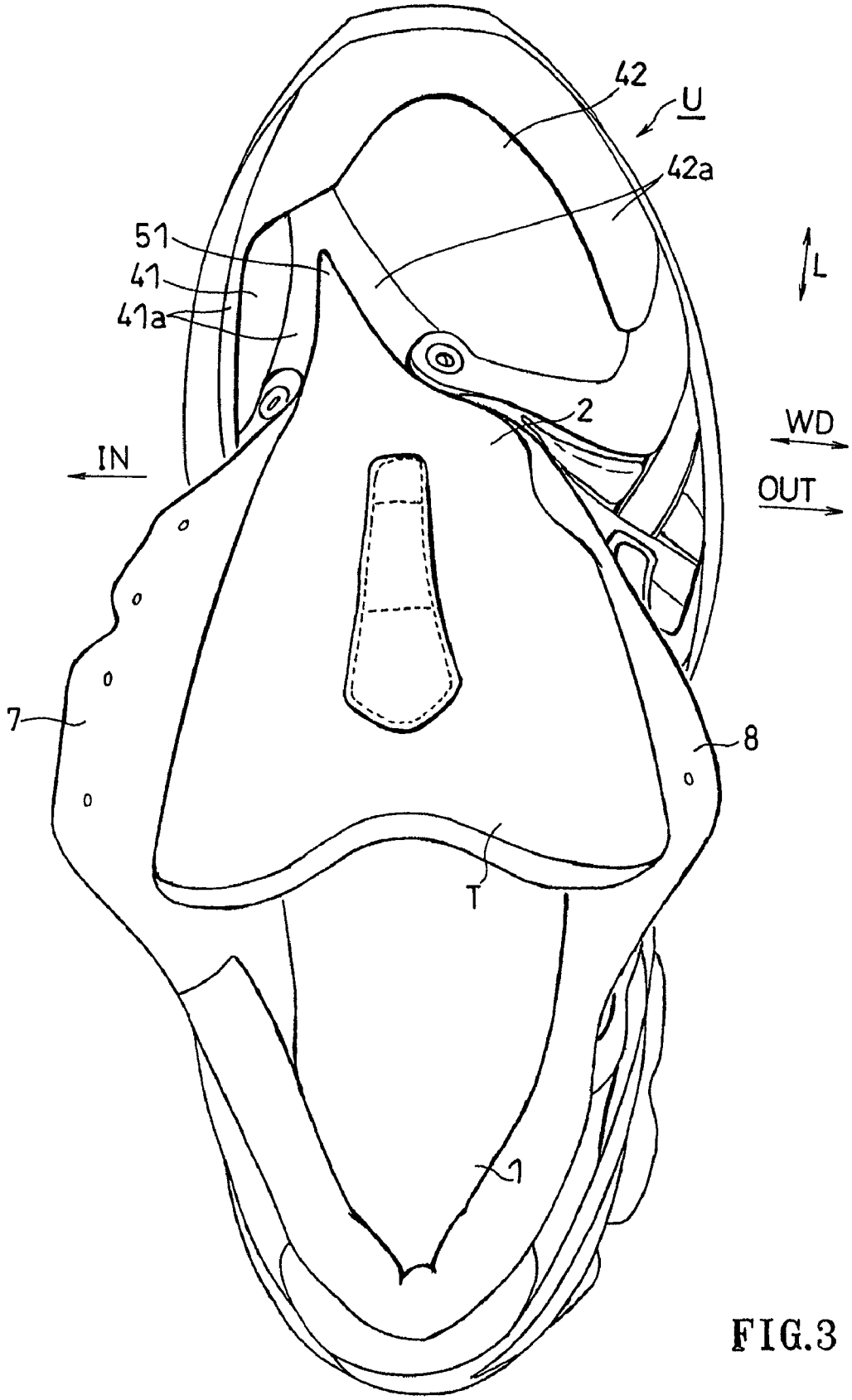
FIG. 3 is a plan view showing the state in which the medial and lateral side portions of the shoe are opened.

As shown in FIG. 2, a first reinforcement portion 41*a*, in which a reinforcement member essentially being hard to be stretched is continuously formed as looped-shape, is provided to an edge portion of the first shape-retaining region 41. And, a second reinforcement portion 42*a*, in which a reinforcement member essentially being hard to be stretched is continuously formed as looped-shape, is provided to an edge portion of the second shape-retaining region 42. By providing these reinforcement portions 41*a* and 42*a*, the shape-retaining regions 41, 42 become regions that each have high shape-retaining property and hard to be deformed.

The deformation region 51 is easier to deform than the first and second shape-retaining regions 41, 42 and is formed in a tapered triangle shape. The deformation region 51 extends diagonally forward between the first and second shape-retaining regions 41, 42. That is, the deformation region 51 extends from a distal end of the second opening 2 to a vicinity of an interphalangeal joint J1 of the big toe. A center line C5 of the deformation region 51 is inclined toward the medial side of the foot as the center line C5 extends toward the front of the foot. Therefore, the center line C5 is inclined with respect to the longitudinal axis L1 of the foot. An inclination (gradients) of the center line C5 of the deformation region 51 with respect to the longitudinal axis L1 is larger than that of the center line C2 of the second opening 2.

In addition, as shown in FIG. 2, the medial side of the upper U is provided with a medial side portion 7 covering the medial side surface of the foot, and the lateral side of the upper U is provided with a lateral side portion 8 covering the lateral side surface of the foot. The medial side portion 7 is provided with a medial stretchable portion 71 being easy to be stretched during exercise, and the lateral side portion 8 is provided with a lateral stretchable portion 81 being easy to be stretched during exercise.

In the shoe of First embodiment, a fastening force applied by the shoe lace 3 causes the deformation region 51 to be shrunk in the width direction WD of the foot, and enables the first and second shape-retaining region 41, 42 to be come closer to each other. Therefore, the fastening force applied by the shoe lace 3 enables the medial and lateral members of the upper U to be pulled by the fastening force toward the ridge line of the instep of the foot in a large area from the second opening 2 to the deformation region 51. And, with eyelet holes 12*a* being provided in the reinforcement members, it is possible for the shape-retaining regions 41, 42 to be efficiently pulled by the shoe lace 3. In addition, in First embodiment, with the deformation region 51 being formed as tapered shape, it is hard for a fabric forming the deformation region 51 to be wrinkled when fitting.

As shown in FIG. 2, the deformation region 51, the shape-retaining regions 41, 42, and surface of the tongue T are formed by the integral net-like mesh material. The reinforcement portion 41*a* and 42*a* are sewn on the mesh material, and are each formed by the reinforcement member that is hard to be deformed. The stretchable members 71, 81 are each formed by a stretch material.

In addition, "surface" means a part that is visible from outside during wearing.

Figure 5:
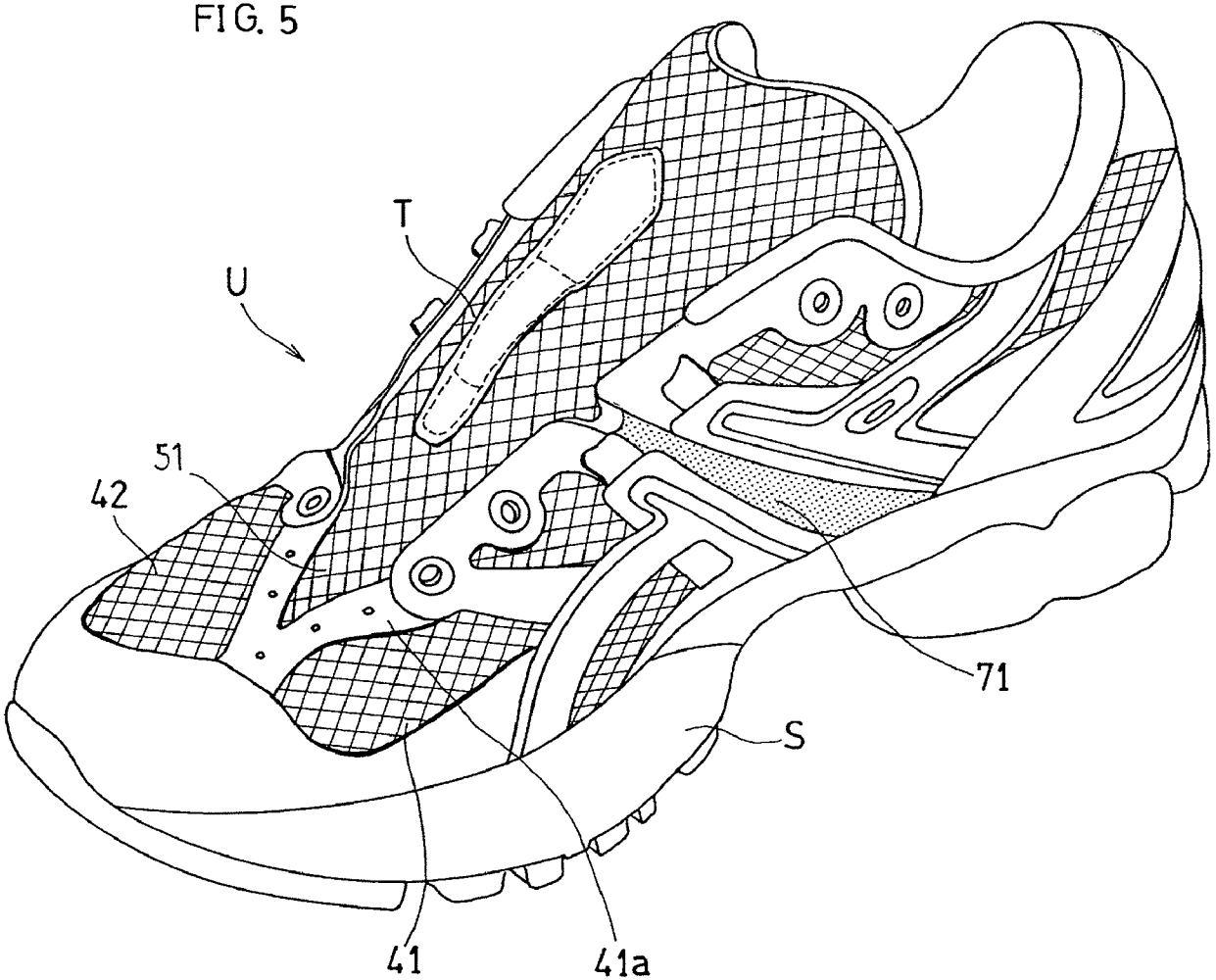
FIG. 5 is a perspective view showing the state in which the shoe lace is detached.
Figure 12A:
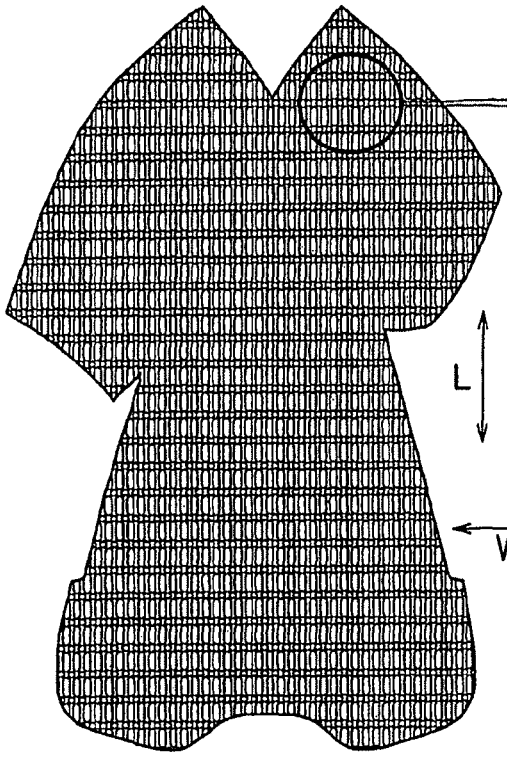
FIG. 12A is a development view of a mesh material comprising a tongue of the upper, a deformation region and shape-retaining region.

As clearly shown in FIG. 4 and FIG. 5, the mesh material, the reinforcement member, and the stretch material are a lot different in material with each other. Therefore, elongation characteristics of each material are different with each other as shown in FIG. 12D. Specific characteristic of the each material is described aforementioned.

In addition, in First embodiment, a mesh material is net-liked material in which generally circular openings are regularly arranged. And, the mesh material is easy to be stretched in a vertical horizontal direction and is hard to be stretched a diagonal direction inclining with respect to the vertical horizontal direction. In First embodiment, a mesh material is provided in a state that the mesh material can be easily stretched in the longitudinal direction of the foot. For example, a material such like artificial leather can be employed as the reinforcement member. And, for example, a material used for a stretchable portion of WO2004/093587 (the entire contents of which are hereby incorporated by reference) can be employed as the stretch material of the stretchable portions 71, 81.

As shown in FIG. 2, the mesh material of First embodiment is provided so as to be continuous from the tongue T to the deformation region 51. That is, a surficial member of the tongue T and that of the deformation region 51 are formed by the same mesh material, and they are continuously formed in the front-rear direction L of the foot.

In addition, the mesh material of First embodiment is provided so as to be continuous from the deformation region 51 to the first and second shape-retaining regions 41, 42. That is, surfaces of the deformation region 51 and the first and second shape-retaining regions 41, 42 are formed by one mesh material continuous over the deformation region 51 and the first and second shape-retaining regions 41, 42 in the width direction WD of the foot. And, the reinforcement members 41*a* and 42*a* are sewn on the shape-retaining regions 41 and 42, surfaces of which are formed by the mesh material.

Then, the mesh material of First embodiment is provided so as to be continuous over the tongue T, deformation region 51 and the first and second shape-retaining regions 41, 42. Therefore, a developed shape of this material is as shown in FIG. 12A. The first and second reinforcement members 41*a*, 42*a* (FIG. 2) and a designated back fabric are sewn on the continuous mesh material, and then a member of the upper anterior to the second opening 2 in the longitudinal direction L is formed. The tongue T and deformation region 51 may differ in the structure other than the surficial mesh material, for example, a resin sponge may be attached to a back side of the tongue T.

Second Embodiment

Figure 6:
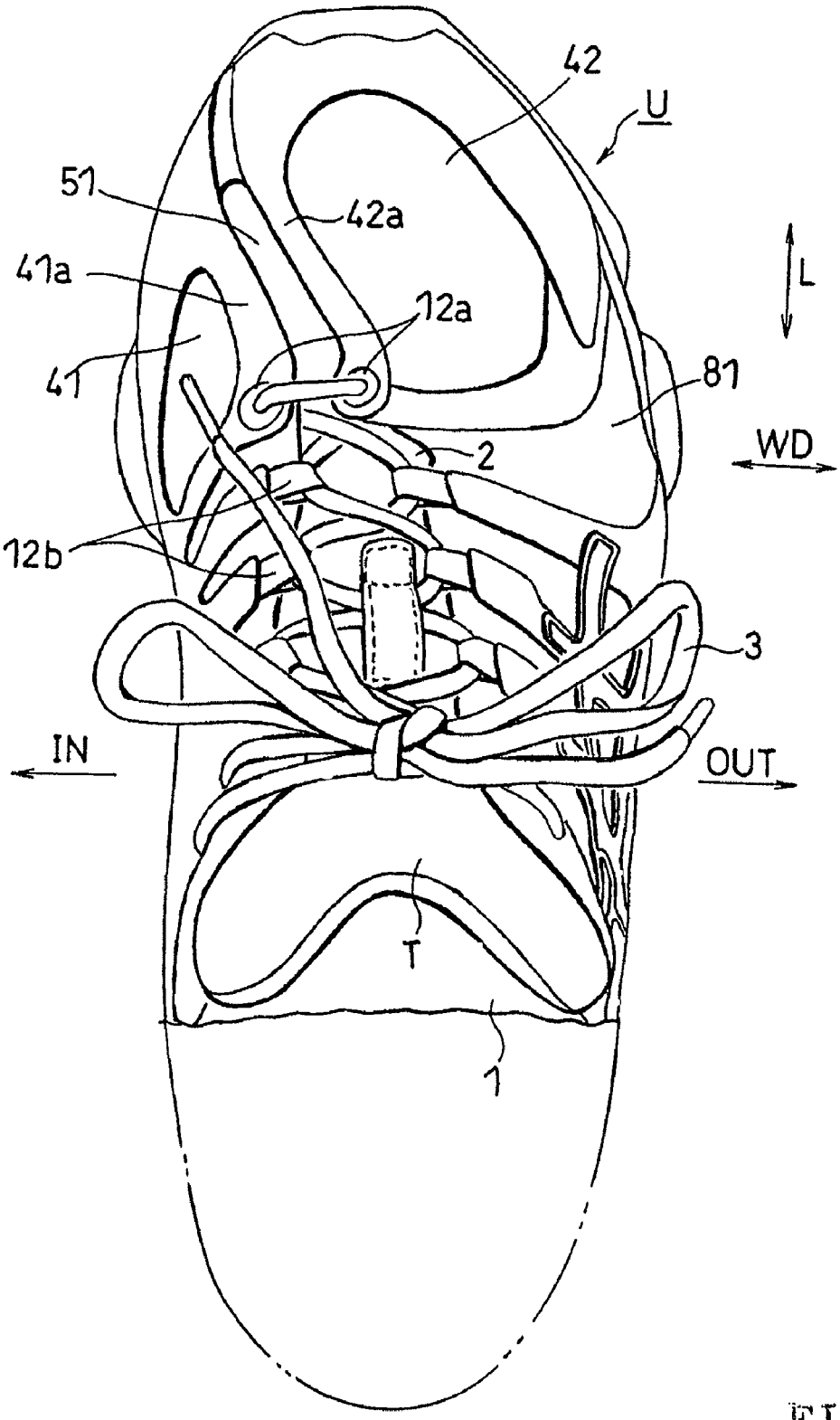
FIG. 6 is a plan view showing the shoe of the second embodiment.
Figure 7:
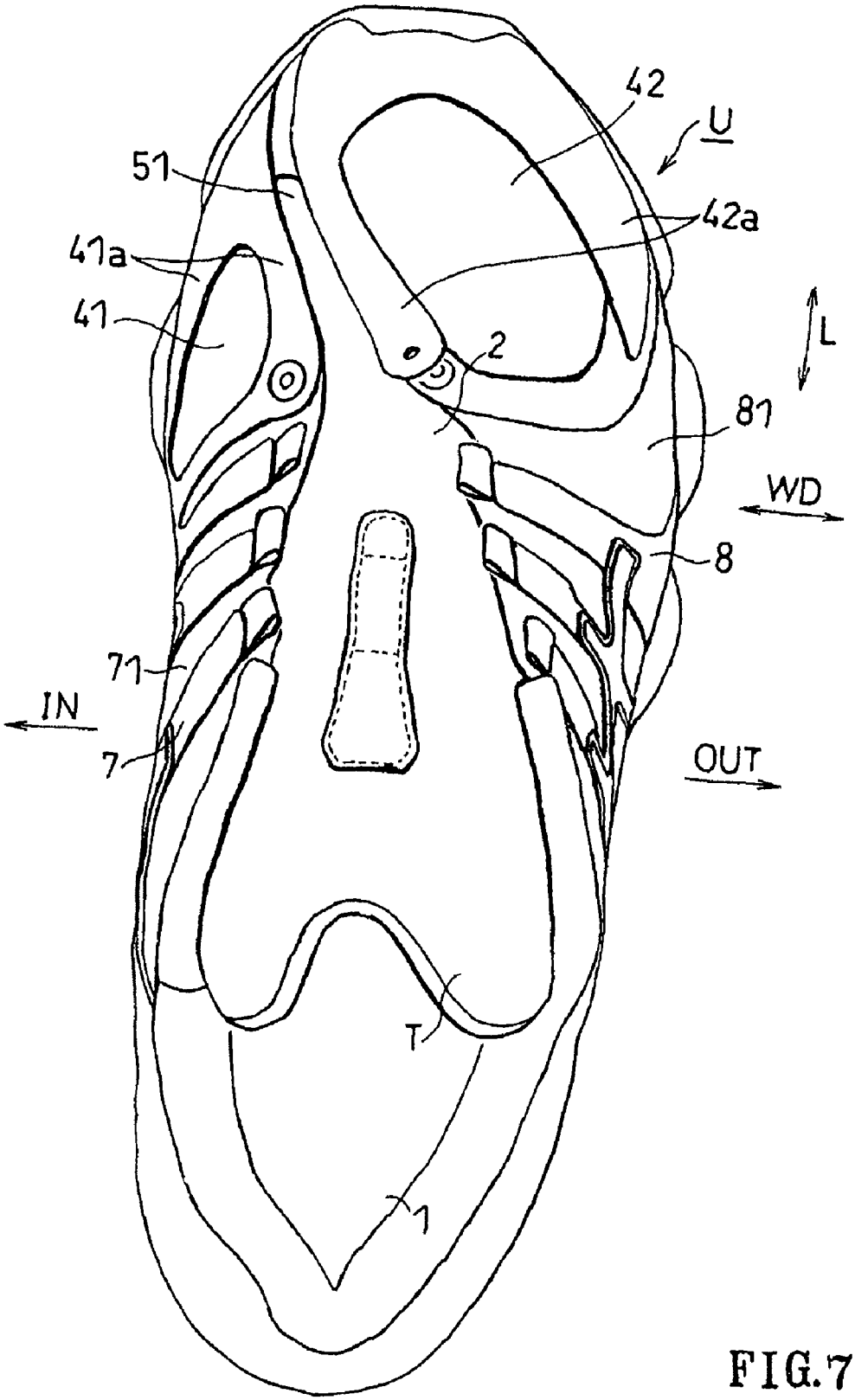
FIG. 7 is a plan view showing the state in which the shoe lace is detached.

FIG. 6 and FIG. 7 each show the shoe of Second embodiment (for right foot).

As shown in FIG. 6 and FIG. 7, in Second embodiment, the deformation region 51 is formed as a generally slit-like shaped. Therefore, most of a region of the deformation region 51 can be evenly shrunk in the width direction WD of the foot. Then, a fabric of the deformation region 51 can be prevented from being wrinkled.

And, in First embodiment, the first and second reinforcement members 41*a*, 42*a* form a generally V-shape with being continuous with each other at an end portion (toe of the foot) of the deformation region 51.

On the other hand, in Second embodiment, the first and second reinforcement members 41*a* and 42*a* are individually formed and separated with each other at an end part of the deformation region. Therefore, when fitting, most of the deformation region 51, including the end part thereof, is easy to be shrunk in the width direction WD of the foot. And, in Second embodiment, the end part of the deformation region 51 is formed as an arc-like shape so as to prevent the deformation region 51 from being torn.

Third Embodiment

FIG. 8 to FIG. 11 each shows the shoe of Third embodiment (for right foot).

Figure 8:
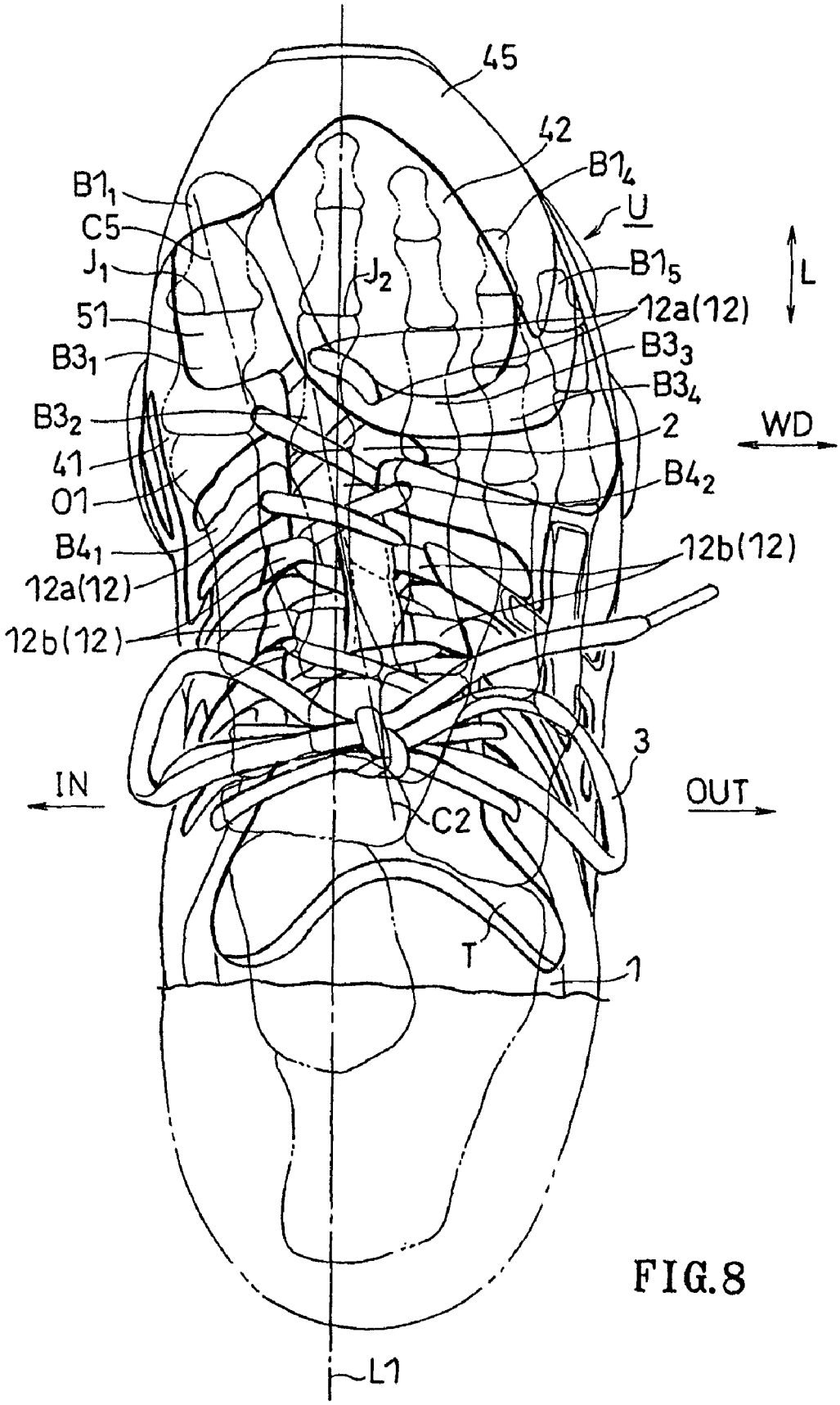
FIG. 8 is a plan view showing the relationship between the shoe of the third embodiment and foot bones.
Figure 10:
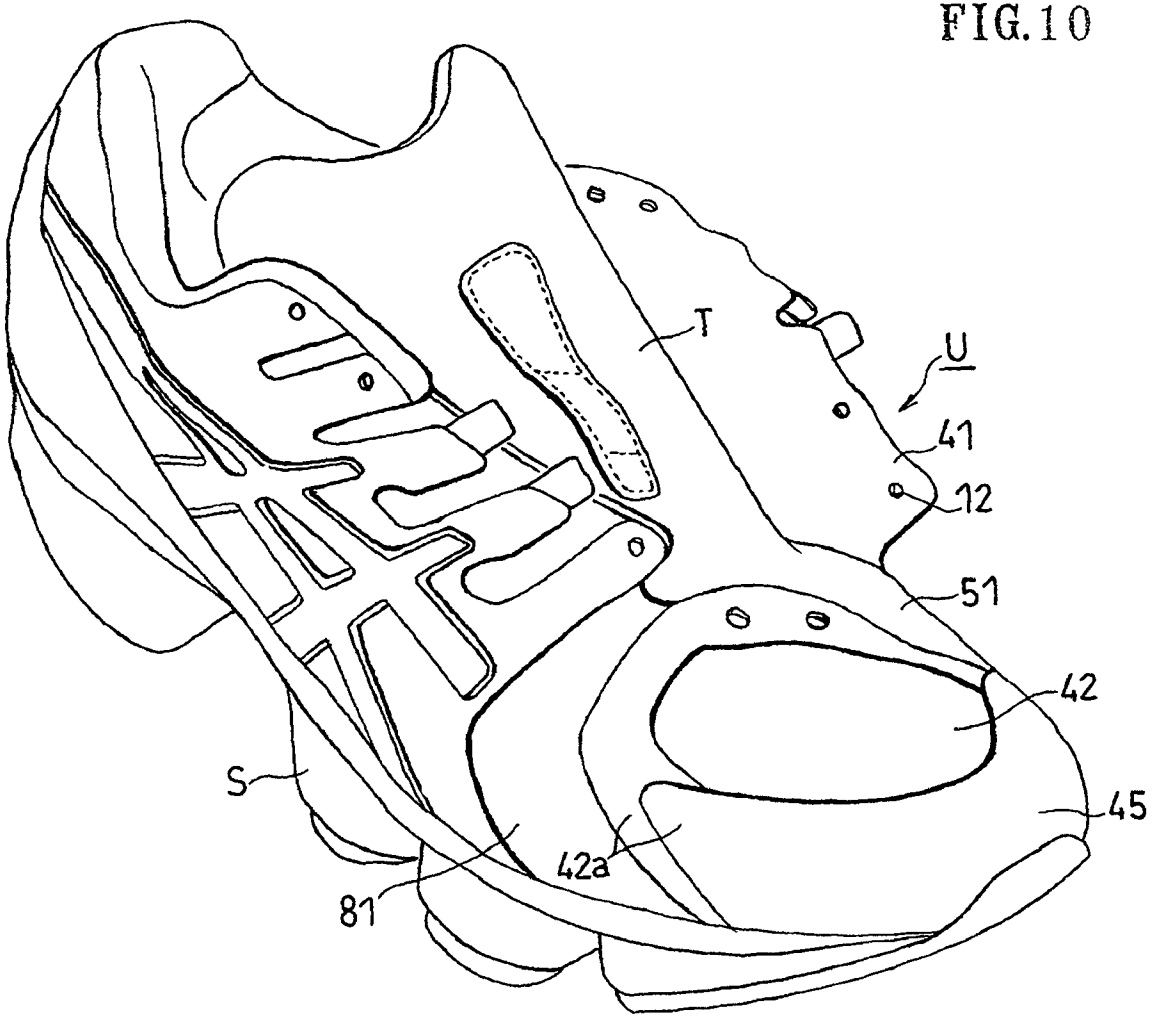
FIG. 10 is a perspective view showing the state in which the medial and lateral side portions of the shoe are opened.
Figure 11:
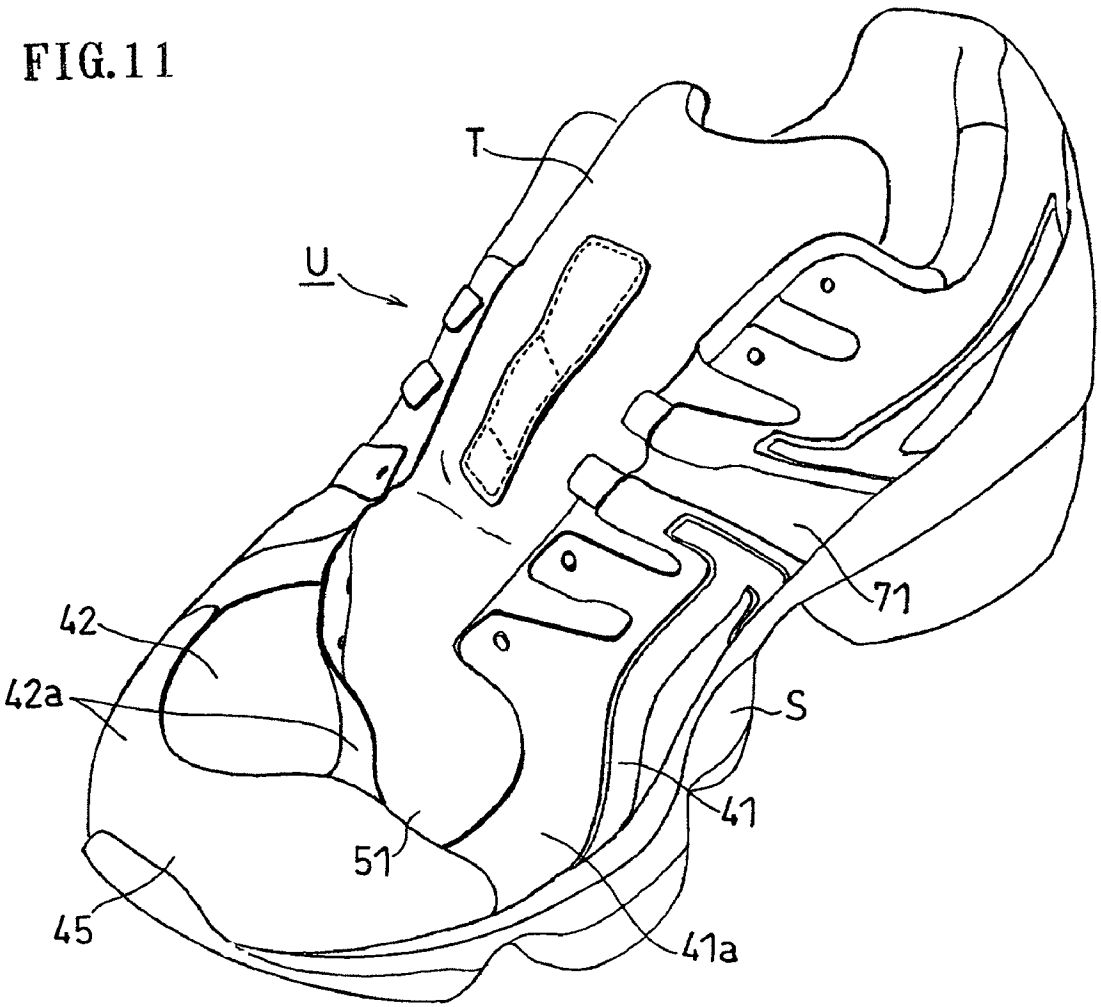
FIG. 11 is a perspective view showing the state in which the shoe lace is detached.

As shown in FIG. 10 and FIG. 11, the shoe of Third embodiment has a sole S absorbing a shock of landing and an upper U covering an instep of the foot. As shown in FIG. 8, the upper U is provided with a plurality of through-holes 12 such as an eyelet hole 12*a* and a loop 12*b*. And, with a shoe lace 3 (an example of a fastening member) which is inserted into the through-holes 12 being fastened, the upper U fits the instep of the foot.

As shown in FIG. 8, the upper U has a first opening 1 from which a leg extends upwardly during wearing and a second opening 2 which is located anterior to the first opening 1 and is closed with a tongue T. The first and second opening 1, 2 are continuous with each other in a front-rear direction of longitudinal direction L of the foot. The tongue T is used for covering the instep of the foot, and a front end of the second opening 2 may be generally located in proximal phalanx $B3_1$ of the big toe or proximal phalanx $B3_2$ of the second toe. The through-holes 12 are provided in the upper U along a circumferential edge of the second opening 2.

The second opening 2 is provided so that a center line C2 thereof extends along a ridge line, which is lined within the big toe and second toe, of the instep of the foot. That is, the center line C2 of the second opening 2 inclines toward a medial side IN of the foot as it extends toward a front of the foot, and then inclines with respect to the longitudinal axis L1 of the foot. The center line C2 may be generally located along a metatarsal bone $B4_2$ and proximal phalanx $B3_2$ of the second toe.

The upper U has a first shape-retaining region 41 covering part of proximal phalanx $B3_1$ and metatarsal bone 41 of the big toe with centering around a medial side of a ball O1 of a big toe, a second shape-retaining region 42 covering a region anterior to the bases of proximal phalanges $B3_2$ to $B3_4$ of the second to fourth toes, and a deformation region 51 which is located between the first and second shape-retaining regions 41 and 42.

In addition, the first shape-retaining region 41 covers the medial side of the foot along from the base of proximal phalanx $B3_1$ of the big toe to a body of distal phalanx $B1_1$ of the big toe.

Figure 9:
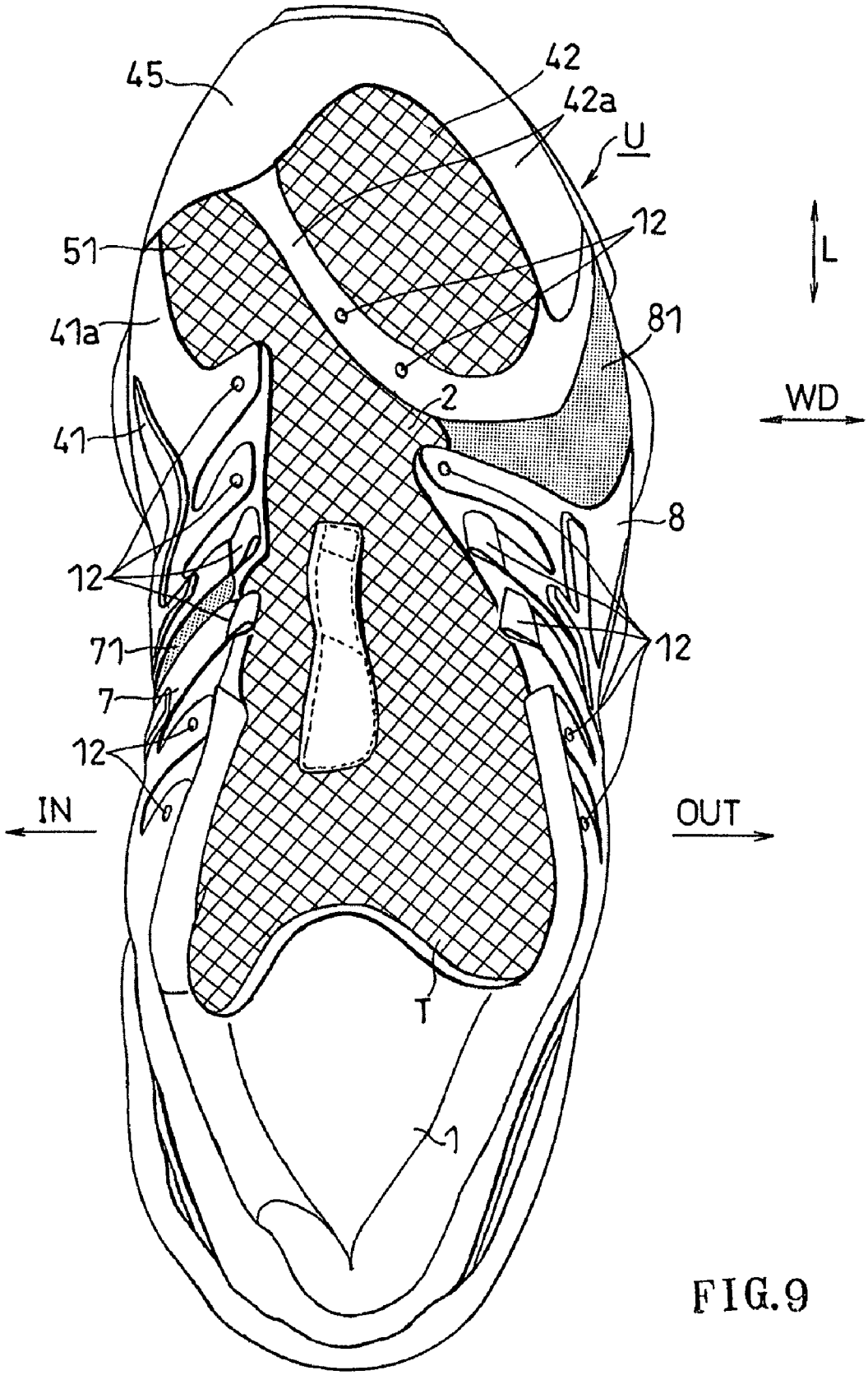
FIG. 9 is a plan view showing the state in which the shoe lace is detached.

As shown in FIG. 9, an edge portion of the first shape-retaining region 41 near the deformation region 51 is provided with a first reinforcement member 41 being consisted of a reinforcement member which is essentially hard to be stretched. As shown in FIG. 9, an edge of the second shape-retaining region 42 is provided with a second reinforcement member 42*a* in which a reinforcement member, which is essentially hard to be stretched, is formed as a loop shape. The shape-retaining regions 41, 42 each has a high shape-retaining property and is hard to be deformed by being provided with the reinforcement members 41*a*, 42*a*.

The deformation region 51 is easier to be deform than the first and second shape-retaining regions 41, 42. As shown in FIG. 8, the deformation region 51 extends diagonally forward toward the front of the foot between the first and second shape-retaining regions 41 and 42. That is, the deformation region 51 extends from the end part of the second opening 2, beyond an interphalangeal joint $J_1$, to distal phalanx $B1_1$ of the big toe. The center line C5 of the deformation region 51 inclines toward the medial side of the foot as it extends toward the front of the foot, that is, it inclines with respect to the longitudinal axis L1 of the foot. The inclination angle of the deformation region 51 is larger than that of the center line C2 of the second opening 2 with respect to the longitudinal axis L1 of the foot. The deformation region 51 of Third embodiment is closer to the medial side of the foot than that of First and Second embodiments and is broadly set in the width direction WD of the foot. That is, the deformation region 51 covers most of the interphalangeal joint $J_1$ of the big toe.

The end part of the deformation region 51, which is at the toe part, is located in generally central of the distal phalanx $B1_1$ of the big toe. A part anterior to the end part, which is an end part of the distal phalanx $B1_1$ of the big toe, is covered with a reinforcement member 45 provided around a circumferential edge of the toe part of the upper. Therefore, the end part of the big toe is stably supported by the reinforcement member 45 and a displacement of the foot inside the shoe is suppressed. The reinforcement member 45 extends along the end of distal phalanx $B1_1$ of the big toe and the circumferential edge of the toe part of the foot, and covers part of distal phalanges of the fourth and fifth toes $B1_4$, $B1_5$. The reinforcement member 45 consists of part of the first and second reinforcement members 41*a*, 42*a*.

In addition, it is preferred that the medial side of the ball O1 of the big toe is covered with the first reinforcement portion 41*a* of the first shape-retaining region 41. Therefore, a displacement of the ball in the width direction WD of the foot is suppressed.

In addition, in Third embodiment, as shown in FIG. 9, the number of the through-holes 12 lining on the lateral side of the foot along the edge of the second opening is larger than one number of the through-holes 12 lining on the medial side of the foot along the edge of the second opening. That is, the through-holes 12 of the upper are unsymmetrically provided in the medial and lateral sides of the foot. The through-holes 12 are provided in both first and second shape-retaining regions 41 and 42, and a forefront through-hole 12 provided in the second shape-retaining region 42 is located anterior to a forefront through-hole 12 provided in the first shape-retaining region 41.

The second shape-retaining region 42 is provided with two through-holes 12. As shown in FIG. 8, the shoe lace 3 is first inserted into a through-hole 12 which is a front (in longitudinal direction L) hole of the two and then is inserted into a through-hole 12 which is a rear (in longitudinal direction L) hole of the two without being inserted the through-holes 12 provided in the first shape-retaining region 41. Therefore, when fitting, a region between the two through-holes, which is from the front hole to the rear hole, is continuously pulled by the shoe lace toward the medial side of the foot. It may be possible that a looped material extending on the second shape-retaining region between the two through-holes 12 is replaced with the two through-holes 12, and the shoe lace 3 is inserted into the looped material.

In addition, as shown in FIG. 9, the medial side of the upper U is provided with a medial side portion 7 covering the medial side surface of the foot, and the lateral side of the upper U is provided with a lateral side portion 8 covering the lateral side surface of the foot. The medial side portion 7 and lateral side portion 8 are provided with a medial stretchable portion 71 and lateral stretchable portion 81, respectively. These stretchable portions are easy to be stretched during exercise. The medial stretchable portion 71 may be provided in the medial side of an arc part of the foot. The lateral stretchable portion 81 may be provided so as to cover a ball of a little toe or vicinity thereof.

And, in Third embodiment, a part forming the forefront through-hole 12 in the first shape-retaining region 41 or a vicinity of the part is not sewn on the tongue T. Therefore, as shown in FIG. 10, a vicinity part of the forefront through-hole 12 of the first shape-retaining region 41 can be moved separately from the tongue T and the deformation region 51. That is, the vicinity of the forefront through-hole 12 of the first shape-retaining region 41 is provided so as to hardly inhibit the deformation of a front portion of the tongue T and the deformation region 51. Therefore, when fitting, the deformation region 51 can be substantially shrunk in the width direction WD of the foot, and the fitting property of the upper improves.

In the shoe of Third embodiment, a fastening force applied by the shoe lace 3 causes the deformation region 51 to be shrunk in the width direction WD of the foot, and enables the first and second shape-retaining region 41, 42 to be come closer to each other. Therefore, when wearing the shoe, both medial and lateral side members can be pulled toward the ridge line of the instep of the foot by fitting the shoe lace 3 in the region over the second opening 2 and the deformation region 51. And, with the eyelet hole 12*a* being provided in a part of the reinforcement member, the shape-retaining regions 41, 42 can be sufficiently pulled by the shoe lace 3 through the eyelet hole 12*a*.

As shown in FIG. 9, the deformation region 51, the second shape-retaining region 42 and the surficial portion of the tongue T are formed by an integral net-like mesh material. The first shape-retaining region 41 may be formed by the mesh material. The reinforcement portion 41*a*, 42*a* are sewn on the mesh material. The stretchable portions 71, 81 are each formed by the stretch material. As First embodiment, a material of the mesh material substantially differs from that of the stretch material.

Figure 12B:
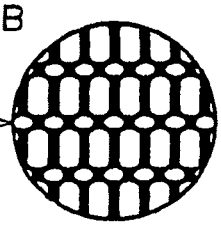
FIG. 12B and FIG. 12C are each partial enlarged view showing part of the mesh material.

In addition, the mesh material of Third embodiment, as shown in FIG. 12B, is formed as a net-like shape so that a generally circular opening and a generally oval opening are regularly arranged. Therefore, the mesh material is easy to be stretched in a vertical horizontal direction of mesh while is hard to be stretched in a direction diagonally inclined with respect to the vertical horizontal direction. A material similar to the material of First embodiment can be employed as a material of the reinforcement member and stretch material.

Figure 12C:
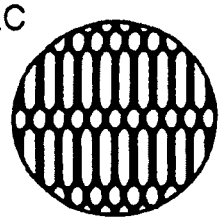
Figure 12D:
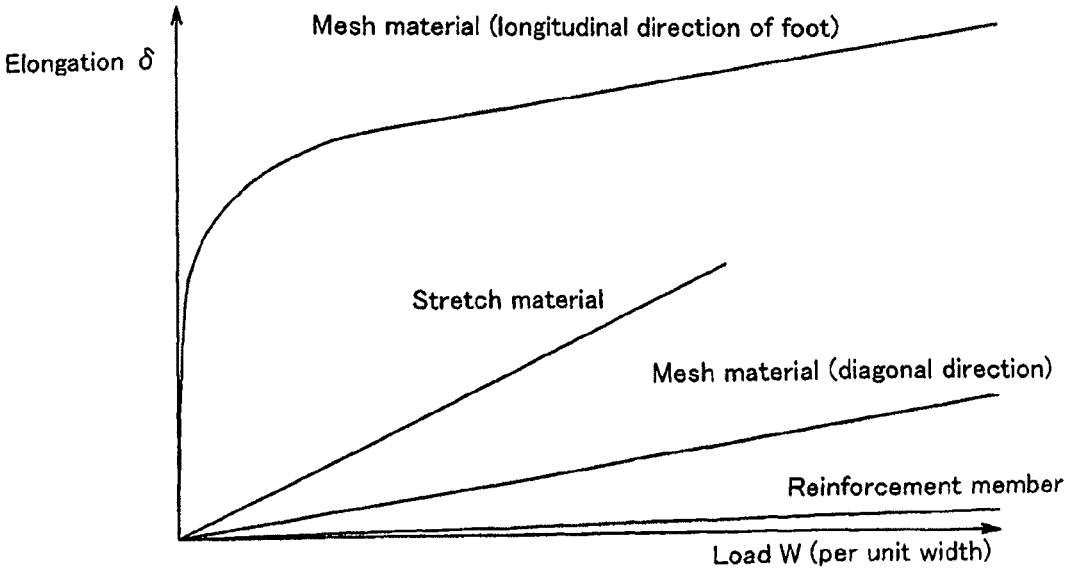
FIG. 12D is a characteristics chart showing elongation characteristic of each material of the upper.

In Third embodiment, the mesh material is set so as to be easily stretched in the longitudinal direction L of the foot. When the mesh material is pulled in the longitudinal direction L of the foot, a shape of the mesh material is deformed so as to be extended in the longitudinal direction L and shrunk in the width direction WD of the foot, as shown in FIG. 12C. As a result, the mesh material is extended in the longitudinal direction L while is shrunk in the width direction WD of the foot. Therefore, when the tongue T is pulled toward the first opening, the deformation region 51 is extended in the longitudinal direction L while is shrunk in the width direction WD of the foot. As a result, the deformation region 51 can be prevented from getting wrinkles.

The mesh material of Third embodiment, as shown in FIG. 9, is continuously provided in the tongue T and the deformation region 51. That is, the surficial material of the tongue T and that of the deformation region 51 are integrally formed by the same material which is continuous in the longitudinal direction L.

In addition, the mesh material of Third embodiment is continuously provided in over the deformation region 51 and the second shape-retaining region 42. That is, the surfaces of the deformation region 51 and the second shape-retaining region 42 are integrally formed by the mesh material which is continuous in the width direction WD of the foot over the deformation region 51 and the second shape-retaining region 42. And the reinforcement member 42*a* is sewn on the deformation region 51 and second shape-retaining region 42.

As described above, the mesh material of Third embodiment is continuously provided in over the surfaces of the tongue T, the deformation region 51, and the second deformation region 42. The second reinforcement member 42*a* is sewn on the mesh material of the second shape-retaining region 42 of the continuous mesh material, and a designated back fabric is sewn on the mesh materials of the deformation region 51 and second shape-retaining region 42. As a result, an upper member anterior to the second opening 2 in the longitudinal direction L of the foot is formed. The tongue T and deformation region 51 may differ in the structure other than the surficial mesh material. For example, the resin sponge may be attached on the back side of the tongue T.

By providing the surficial mesh material in over the tongue T and the deformation region 51, there is no sewing line on the mesh material of the deformation region 51. Therefore, the deformation region 51 can be easily deformed. And, as described above, the vicinity of the forefront through-hole 12 of the first shape-retaining region 41 is provided so as to not inhibit the deformation of the tongue T and deformation region. Therefore, with the tongue T being pulled toward the first opening, the deformation region 51 is easily deformed as shown in FIG. 12, and can be shrunk in the width direction WD of the foot.

While preferred embodiments of the present invention have been described above with reference to the drawings, obvious variations and modifications will readily occur to those skilled in the art upon reading the present specification.

For example, the first and second shape-retaining regions may be provided with through-holes so that the deformation region is formed in a tapered triangle shape and a number of through-holes in the second shape-retaining region is larger than that of through-holes in the first shape-retaining region, while the forefront through-hole provided in the second shape-retaining region is located anterior to the forefront through-hole in the first shape-retaining region.

In addition, although it is preferred that the stretchable portion is located in the region described in First to Third embodiments, this is not an indispensable case. And, the stretchable portion may be provided in either the medial or lateral side of the shoe. It is not necessary for the shape of the stretchable portion to be formed as First to Third embodiments, various shapes can be employed as shape of the stretchable portion.

Thus, such variations and modifications shall fall within the scope of the present invention as defined by the appended claims.

INDUSTRIAL APPLICABILITY

The present invention is applicable to various sports shoes.

The invention claimed is:

1. A sports shoe suitable for exercise, comprising:

a sole absorbing a shock of landing, an upper covering an instep of a foot, and a fastening member fitting the upper to the instep of the foot, wherein the upper has a first opening from which a leg extends upwardly during wearing and a second opening which is closed with a tongue covering the instep of the foot, and the first and second openings are continuous with each other in a front-rear direction, wherein the upper comprises:

a first shape-retaining region covering at least a medial side surface of a ball of a big toe;

a second shape-retaining region covering at least a part of a proximal phalanx of a third toe; and a deformation region being located anterior to the second opening between the first and second shape-retaining regions and being easier to deform than the first and second shape-retaining regions, wherein the first and second shape-retaining regions come closer to each other by a fastening force applied by the fastening member and a main member forming the upper in the deformation region shrinks in a width direction of the foot by the fastening force, a center line of the second opening inclines toward a medial side of the foot along a ridge line of the instep of the foot as it extends toward a front of the foot, the deformation region is continuous with the second opening, and a center line of the deformation region inclines toward the medial side of the foot as it extends toward the front of the foot from a front end of the second opening, and the deformation region extends to at least one of an interphalangeal joint of the big toe and an interphalangeal joint of a second toe, the upper further has a plurality of first through-holes and a plurality of second through-holes, and the fastening member consisting of a shoe lace is inserted into the first and second through-holes, the first through-holes line up, along an edge of the second opening, more medially than the edge of the second opening, the second through-holes line up, along the edge of the second opening, more laterally than the edge of the second opening, and a first distance, along the width direction of the foot, between a forefront first through-hole of the first through-holes and a medial end of the shoe is smaller than a second distance, along the width direction of the foot, between a forefront second through-hole of the second through-holes and a lateral end of the shoe.

2. A sports shoe according to claim 1, wherein an inclination of the center line of the deformation region with respect to a longitudinal axis of the foot extending in a front-rear direction of the foot is larger than an inclination of the center line of the second opening with respect to the longitudinal axis of the foot.

3. A sports shoe according to claim 1, wherein the main member forming the deformation region is formed by a fabric, and the fabric extends in a longitudinal direction of the foot and shrinks in the width direction of the foot by pulling the tongue toward the first opening.

4. A sports shoe according to claim 2, wherein a surficial member of the tongue and a surficial member of the deformation region are formed by a same member and are continuously formed in the front-rear direction.

5. A sports shoe according to claim 2, wherein the upper further comprises:

a medial side portion covering a medial side surface of the foot;

a lateral side portion covering a lateral side surface of the foot; and a stretchable portion forming a part of the medial side portion and/or a part of the lateral side portion and being easy to be stretched.

6. A sports shoe according to claim 2, wherein the upper further comprises:

a first reinforcement portion provided at an edge portion of the first shape-retaining region; and a second reinforcement portion provided at an edge portion of the second shape-retaining region, wherein the first reinforcement portion is provided with at least one first through-hole of the first through-holes, and the second reinforcement portion is provided with at least one second through-hole of the second through-holes.

7. A sports shoe according to claim 2, wherein the upper comprises:

the main member being continuous over the first shape-retaining region, the deformation region, and the second shape-retaining region in the width direction of the foot;

a reinforcement member being harder to deform than the main member, and being provided for retaining shapes of the first and second shape-retaining regions;

a first reinforcement portion in which one part of the reinforcement member is fixed on the main member in an edge portion of the first shape-retaining region; and a second reinforcement portion in which another part of the reinforcement member is fixed on the main member in an edge portion of the second shape-retaining region, wherein the main member forming the deformation region shrinks in the width direction of the foot between the first and second reinforcement portions.

8. A sports shoe according to claim 1, wherein the first through-holes are more medially positioned than a longitudinal axis of the foot extending in a front-rear direction of the foot.

9. A sports shoe according to claim 1, wherein a number of the second through-holes is larger than a number of the first through-holes.

10. A sports shoe according to claim 1, wherein the shoe lace is continuously inserted into the second through-holes from the forefront through hole of the second through-holes provided in the second shape-retaining region to a secondary front through-hole of the second through-holes provided in the second shape-retaining region without being inserted into the first through-holes.

11. A sports shoe according to claim 1, wherein a part forming the forefront through-hole of the first through-holes in the first shape-retaining region is free from being sewn on the tongue.

* * * * *